United States Patent [19]

Eheim et al.

[11] 4,407,250

[45] Oct. 4, 1983

[54] FUEL INJECTION SYSTEM

[75] Inventors: Franz Eheim, Stuttgart; Gerald Höfer, Weissach-Flacht; Heins Links, Baiersbronn, all of Fed. Rep. of Germany

[73] Assignee: Robert Bosch GmbH, Stuttgart, Fed. Rep. of Germany

[21] Appl. No.: 225,166

[22] Filed: Jan. 15, 1981

[30] Foreign Application Priority Data

Jan. 15, 1980 [DE] Fed. Rep. of Germany ..... 3001166

[51] Int. Cl.[3] ..... F02M 41/06; F02D 1/02

[52] U.S. Cl. ..... 123/450; 123/467; 123/500; 123/502

[58] Field of Search ..... 123/446, 447, 467, 449, 123/450, 500, 501, 502, 503

[56] References Cited

U.S. PATENT DOCUMENTS

| | | | |
|---|---|---|---|
| 3,615,043 | 10/1971 | Hussey et al. | 123/450 X |
| 4,170,974 | 10/1979 | Kopse et al. | 123/467 |
| 4,215,662 | 8/1980 | Nozaki et al. | 123/449 X |
| 4,271,807 | 6/1981 | Links et al. | 123/467 X |
| 4,280,464 | 7/1981 | Kanai et al. | 123/447 |

*Primary Examiner*—Tony M. Argenbright
*Attorney, Agent, or Firm*—Edwin E. Greigg

[57] ABSTRACT

The invention relates to a fuel injection system having a pump/nozzle for which the fuel is metered by one apparatus and the injection onset is determined by a second apparatus. In accordance with the invention, these apparatuses each operate with a distributor, both distributors being combined into a single structural unit. Because of this combination, structural possibilities are created which, both functionally and in terms of manufacturing cost, represent substantial improvements in the field of injection systems.

30 Claims, 19 Drawing Figures

FUEL INJECTION SYSTEM

BACKGROUND OF THE INVENTION

The invention is based on an internal combustion engine fuel injection system that functions with pump nozzles. In a known fuel injection system of this kind, the apparatus for controlling the injection onset is arranged to control the servo fluid for the pump piston drive in proportion with the cycles of the engine and is entirely separate from the fuel metering apparatus that determines the fuel quantity to be injected and stored in a chamber below the pump piston. The two apparatuses have in common solely that they are both driven by the internal combustion engine. Injection systems which operate with pump/nozzles are well known to be relatively expensive both in terms of structure and cost. If injection systems of this kind are to be introduced into mid-size engines mass-produced in high quantities as well, then the system's apparatuses and the manner in which they are embodied must be greatly simplified. On the other hand, the particular advantage of such fuel injection systems is their high adaptability to various engines; in other words, they can favorably be made to perform injection in the particular required manner. It is critically important in this context that the various individual interventions made into the fuel metering, injection onset, duration of fuel supply, and so forth be capable of being performed independently of one another. Despite this consideration, in known fuel injection systems any structural simplifications or changes made in order to spare expense also restrict the required capacity of the system to be initially or subsequently adjusted. The total expenditure for such a system, in this case, is then no longer in proper proportion to the advantages which are attainable with such a system.

OBJECT AND SUMMARY OF THE INVENTION

The fuel injection system according to the invention and having the characteristics of the main claim has the advantage over the prior art that the generally expensive control of the fluid for the injection onset controlling apparatus and the fuel metering apparatus is accomplished in a single structural unit, which has only one distributor. A structural unit of this kind is not only less expensive than the previously known, separate units; also, the number of lines, which could cause leakage, is fewer, and there is a very precise distributor control of the various apparatuses. Not least in importance, the structural unit is quite saving of space, which is particularly significant in the field of motor vehicle design.

The invention will be better understood and further objects and advantages thereof will become more apparent from the ensuing detailed description of several preferred embodiments, taken in conjunction with the drawings.

DESCRIPTION OF THE PREFERRED EMBODIMENTS

Figure 1:
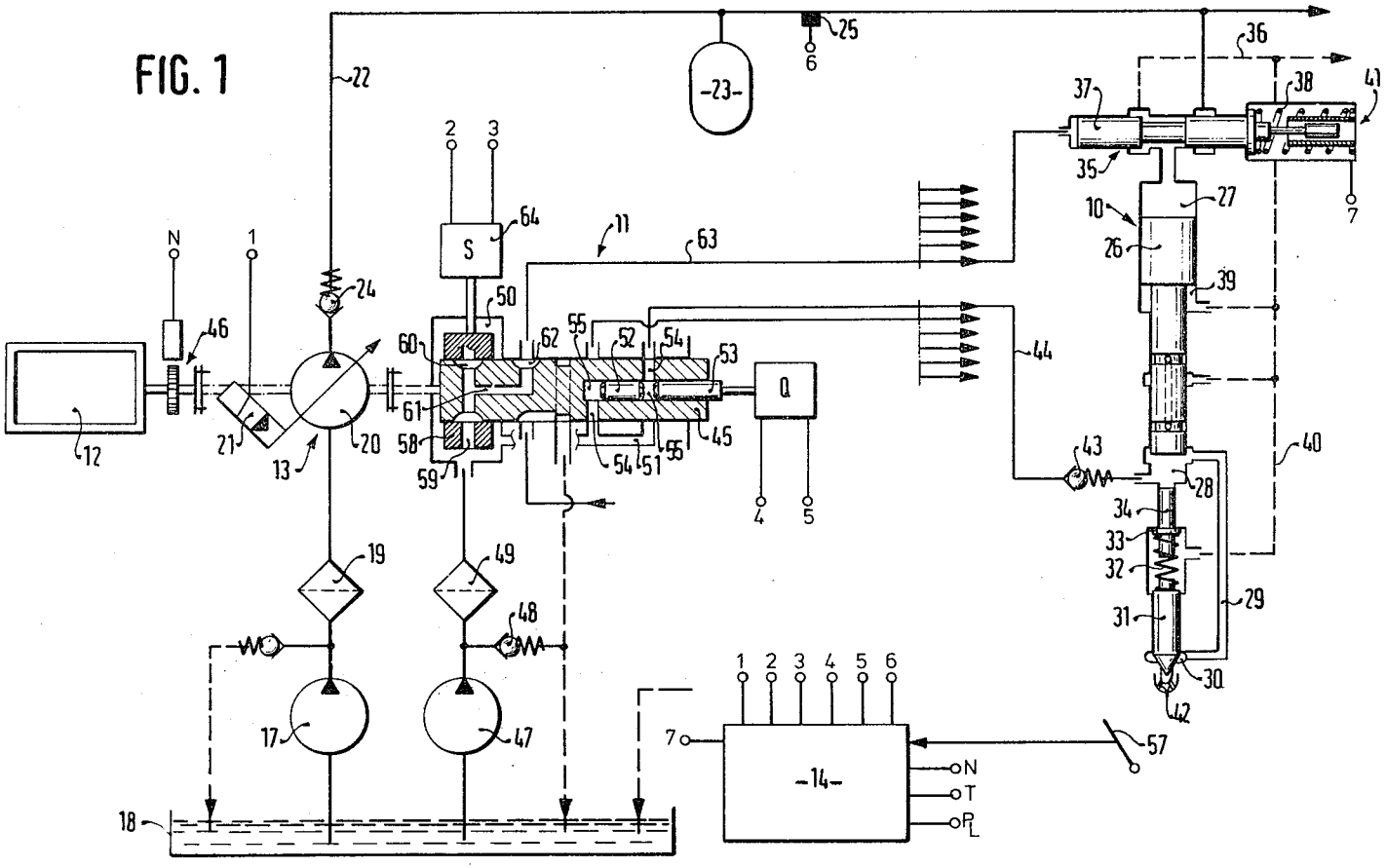
FIGS. 1–11 show various distributor units with fuel metering performed by an intermediate piston.

In FIG. 1, a fuel injection system is shown for a six-cylinder engine. However, only one pump/nozzle 10 is shown, which is opened under the control of a metering and distributor unit 11 also controlling the other five pump/nozzles. While the metering and distributor unit 11 operates at an average fuel pressure, a pump system 13 also driven, like the metering and distributor unit 11, by the internal combustion engine 12 generates the high pressure for a servo fluid, which again is preferably fuel. The fuel injection system is regulated with the aid of an electronic control device 14, in which actual-value signals picked up at various points, as described below, are processed and appropriate set-point signals are fed via converters to the appropriate control elements of the injection system.

The high-pressure system 13 operates with two pumps disposed one after the other; the first is a prepump 17, which aspirates the fuel out of a container 18 and supplies it via a filter 19 to the second, which is a servopump 20 acting as the high-pressure pump. An electrical zero-stroke control element or pressure maintenance valve serves to maintain sufficient pre-supply pressure. The pressure or the supply output of the servopump 20 can be varied via a magnetic control element 21. The magnetic control element 21, as a converter, receives the appropriate control signal from the electronic control device 14 via the terminal 1. A pressure line 22 leads from the servopump 20 to the individual pump/nozzles, which are all supplied with servo fluid, generally fuel, from this high-pressure line 22. A pressure reservoir 23 is connected to the pressure line 22 in order to maintain a substantially constant pressure at the nozzles. The pressure line 22 is coupled with the servopump 20 by way of a check valve 24. The pressure in the line 22 is measured by a transducer 25 and then fed to the electronic control device 14 via the connection terminals 6. Then, either the electronic control device 14 effects a correction of the supply pressure of the pump via the magnetic control element 21, if changes have been ascertained by the pressure transducer 25, or else this correction causes a change in the high pressure in accordance with other engine characteristics which have been fed into the electronic control device 14.

The pump/nozzles 10, only one of which is shown, operate with a servopiston 26. The servopiston 26 is embodied as a stepped piston (or it is made up of two pistons having different diameters), the larger face of which defines a servopressure chamber 27 and the smaller face of which defines the pump work chamber 28. A pressure line 29 leads from the pump work chamber 28 to the pressure chamber 30 of the nozzle. The nozzle operates with a nozzle needle 31, which is urged in the closing direction by a closing spring 32. The closing spring 32 is supported, on its side remote from the nozzle needle 31, on a shoulder 33 of a closing piston 34, which protrudes with its end face remote from the nozzle needle into the pump work chamber 28.

Communication between the servopressure line 22 and the servopressure chamber 27 is controlled by means of a slide valve 35. This slide valve 35 is actuated in synchronism with the cycles of the engine 12 by the metering and distributor unit 11, and it thus alternatively connects the servopressure chamber 27 with either the pressure line 22 or a relief line 36. The slide valve 35 operates with a control slide 37, which is hydraulically driven and displaceable counter to a restoring spring 38. The chamber 39 formed by the step of the servopiston 26 and the chambers receiving the springs 32 and 38 all communicate via a leakage line 40 with the relief line 36. The position and/or the distance travelled by the control slide 37 is measured by a travel transducer 41 and fed via the terminals 7 into the electronic control device 14.

The described pump/nozzle functions as follows:

The pump work chamber 28 is supplied by the metering and distributor unit 11 with a metered quantity of fuel via a metering line 44 and a check valve 43. The servopiston 26 is displaced during this operation into the servochamber 27, thus forcing fuel out via the slide valve 35 into the relief line 36. Then as soon as the control slide 37 has been displaced counter to the spring 38 by the metering and distributor unit 11, the servopressure line 22 is connected with the servopressure chamber 27; this occurs either after or shortly before the servopressure chamber 27 is separated from the relief line 36. As a result, the servopiston or pump piston 26 is displaced into the pump work chamber 28, thus forcing fuel via the pressure line 29 into the pressure chamber 30. As soon as a sufficiently high pressure has been attained, the valve needle 31 is displaced counter to the spring 32, so that the fuel reaches the combustion chamber of the engine via injection ports 42. After a predetermined supply stroke of the pump piston 26, its lower end face blocks the discharge to the pressure line 29, so that the fuel pressure in the chamber 28 increases further, until the closing piston 34 is first pressed against the spring 32 and then directly against the nozzle needle 31. In the meantime the supply to the pressure chamber 30 via the pressure line 29 has been interrupted, resulting in a rapid and good-quality closure of the injection nozzle. Then as soon as the control slide 37 slides back into its outset position in which it is shown in the drawing, which occurs under the control of the metering and distributor unit 11, fuel can again be metered into the pump work chamber 28, whereupon the pump piston 26 is again displaced accordingly. A new injection procedure can take place.

The metering and distributor unit 11 functions with a distributor 45, which is driven by the engine 12. The rpm of the distributor 45, and in the exemplary embodiment of the high-pressure pump 20 as well, is measured via an rpm transducer 46 and fed via the terminals N/N into the electronic control device 14. The distributor 45 has a twofold control function: first, it distributes a metered quantity of fuel to the various individual pump-/nozzles; and second, it determines the injection onset by actuating the control slides 37 (reversable valves). The distributor 45 receives fuel from a pump 47 which generates an average pressure. The supply pressure of this pump 47 is determined by a pressure control valve 48. A filter 49 is disposed between the pump 47 and the distributor unit 11. The fuel proceeds from the average-pressure pump 47 into a receptacle chamber 50 in the housing of the metering and distributor unit 11. From the receptacle chamber 50, the fuel then proceeds via a line 51 to the actual fuel metering apparatus. This fuel metering apparatus comprises a reciprocating metering piston 52, whose stroke is determined by a stop 53. The chambers 55 at either side of the metering piston 52 communicate via appropriate distributor bores 54 in the distributor 45 with the line 51 or the metering line 44 of the pump/nozzle in such a manner that one of the chambers 55 always communicates with the line 51 and the other of the chambers 55 communicates with the pump work chamber 28 and thus with the pump/nozzle. The metering piston 52 is displaced by the fuel flowing in via the line 51 and thus supplies fuel via the metering line 44 into the pump work chamber 28 until such time as the meterng piston 52 strikes against the stop 53. The stop 53, in turn, is adjustable, so that the travel distance of which the metering piston 52 is capable determines the injection quantity. The initial points of the metering lines 44 and the point of discharge of the line 51 are distributed about the distributor 45 in such a fashion that the pump work chamber 28 of one pump nozzle after another is always being supplied with fuel, and this always takes place in alternation from one of the two metering chambers 55. The stop 53, in this exemplary embodiment, is adjusted by a servomotor Q, which receives its control signal via the terminal 4 from the electronic control device 14. At the same time, an actual-value transducer is available in the servomotor Q which furnishes the actual position of the stop 53 to the electronic control device 14 via the terminals 5. The fuel quantity to be injected is determined in the electronic control device 14 in accordance with various input variables. One of these input variables is the position of the gas pedal 57; another variable is the rpm, fed by the rpm transducer 46 via the terminal N. Other variables may be the temperature T or the air pressure $P_L$. In each case, there is a virtually optimal degree of freedom in the influence exerted upon the fuel injection quantity. Because the injection onset is determined in this case independently of the fuel metering, the distribution of the metered quantities to the individual nozzles can be made within fairly broad tolerances.

The second function of the distributor 45 is the control of the injection onset. To this end, an annular slide 58 is disposed about the distributor 45 in the vicinity of the receptacle chamber 50. This annular slide 58 has radial bores 59, which are opened during the rotation of the distributor 45 by longitudinal grooves 60 disposed in the jacket face of the distributor. A channel 61 disposed in the distributor 45 leads from the longitudinal grooves 60 to a longitudinal distributor groove 62 disposed in the jacket face of the distributor. This longitudinal distributor groove 62 opens up the discharge ends of control lines 63, which lead to the various pump/nozzles and then to the slide valves 35. The initial ends of the control lines 63 are correspondingly distributed about the circumference of the distributor 45, so that the slides 37 are actuatable one after another by means of the fuel flowing in from the receptacle chamber 50. The amount of overlap of the longitudinal groove 62 at the individual control lines 63 is relatively large, so that it is not necessary here to keep to precise tolerances. The opening up of the bores 59 by the longitudinal grooves 62, on the contrary, must be effected quite precisely, because this action determines the injection onset. Whenever the slide 37 of the pump/nozzle connects the pressure line 22 with the servopresure chamber 27, the injection begins. In order to be able to vary this injection onset, the annular slide 58 is rotatable on the distributor 45. As a result, the instant at which the longitudinal grooves 60 open the radial bores 59 is shifted relative to the rotary position of the drive shaft. The onset of injection—that is, the beginning of the actuation of the slide 37—is shifted accordingly. An injection time adjustment of this kind may be required for various reasons, in accordance with the rpm or in accordance with load, temperature, or other engine characteristics, for example. The rotation of the annular slide 58 is effected with the aid of a servomotor 64. This servomotor 64, as a converter, receives its actuation signal from the electronic control device 14 via the terminals 2. The actual position of the annular slide 58 is fed to the electronic control device 14 as a transducer valve via the terminals 3. In order to correct any errors which might be produced by the hydraulic actuation, the transducer value of the servomotor 64 is compared with the transducer value of the transducer 41 from the slide valve 35. Here, as well, it is possible to attain an optimum result in terms of fine adjustment and in terms of influencing the fuel injection quantity, especially in consideration of various engine characteristics.

As a result of the selected combination of electronic transducers, electric converters and mechanical control elements, it is possible to influence the performance of injection via engine characteristics, without there being disadvantageous secondary influence exerted by various control units, such as the metering apparatus and the injection onset apparatus.

Figure 2:
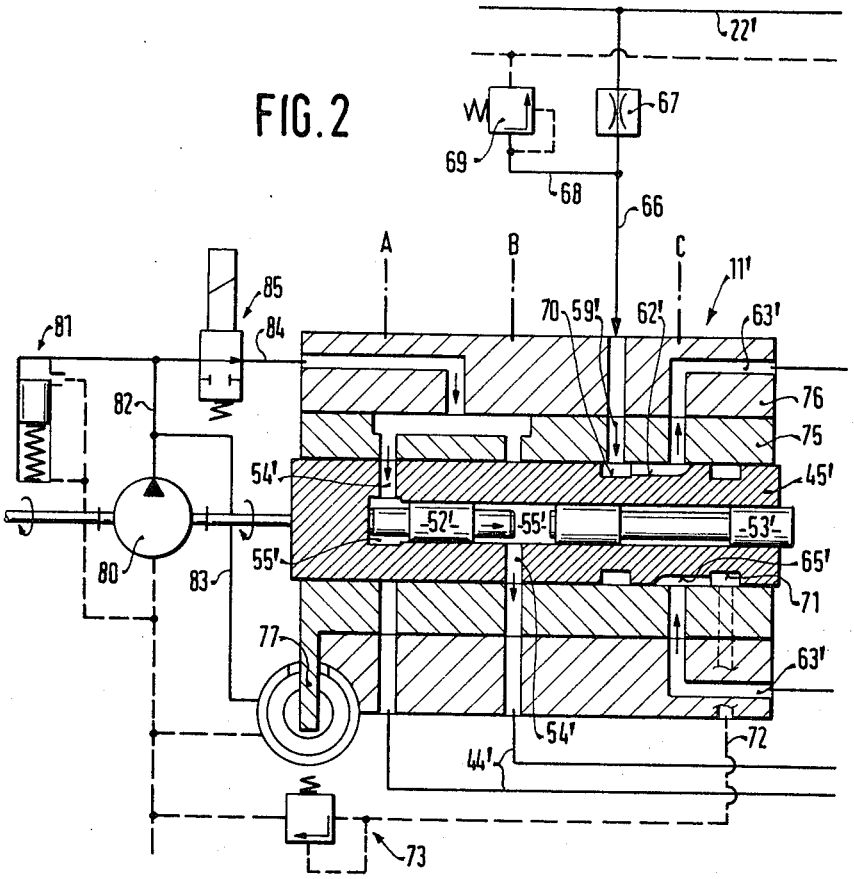

In FIG. 2, a metering and distributor unit is shown which functions in principle like that shown in FIG. 1. However, in contrast to the exemplary embodiment shown in FIG. 1, the fluid for controlling the injection onset is not drawn from the average-pressure pump for fuel; instead, it is taken from the high-pressure line 22' for the servofluid. The servofluid may, for example, be a more viscous oil acting as fuel, in order thereby to keep leakage amounts smaller; leakage is especially prevalent, of course, at high pressures. In order to arrive at an appropriate control pressure, a throttle 67 is inserted into the line 66 leading from the high-pressure line 22' to the distributor unit 11'. Downstream of this throttle 67, a control line 68 in which a pressure maintenance valve 69 is disposed branches off from the line 66. This manner of obtaining the control fluid for the injection onset is shown here purely by way of example. Naturally, in this exemplary embodiment shown in FIG. 2 as well, it is possible for fuel, or some other fluid supplied by an average-pressure pump, to be used as the control fluid.

The fuel then flows out of the line 66 via the radial bore 59' and reaches an annular groove 70 disposed in the jacket face of the distributor 45'. The longitudinal distributor groove 62' then branches off from this annular groove 70 and opens up the discharge ends, distributed about the circumference of the distributor 45', of the control lines 63' leading to the pump/nozzles in order to actuate the control slide disposed on the pump/nozzle. The control lines 63' not connected to the distributor groove 62' may be relieved of pressure via longitudinal grooves 65', in order to enable a return stroke of the control slide of the pump/nozzle. The longitudinal groove 65' is likewise disposed in the jacket face of the distributor 45'. It discharges into an annular groove 71, which in turn communicates permanently with a leakage line 72. A pressure maintenance valve 73 is disposed in the leakage line 72 in order to maintain a mininum pressure in the control system for the injection onset, so that an overload of the control line is prevented from occurring.

Figure 5:
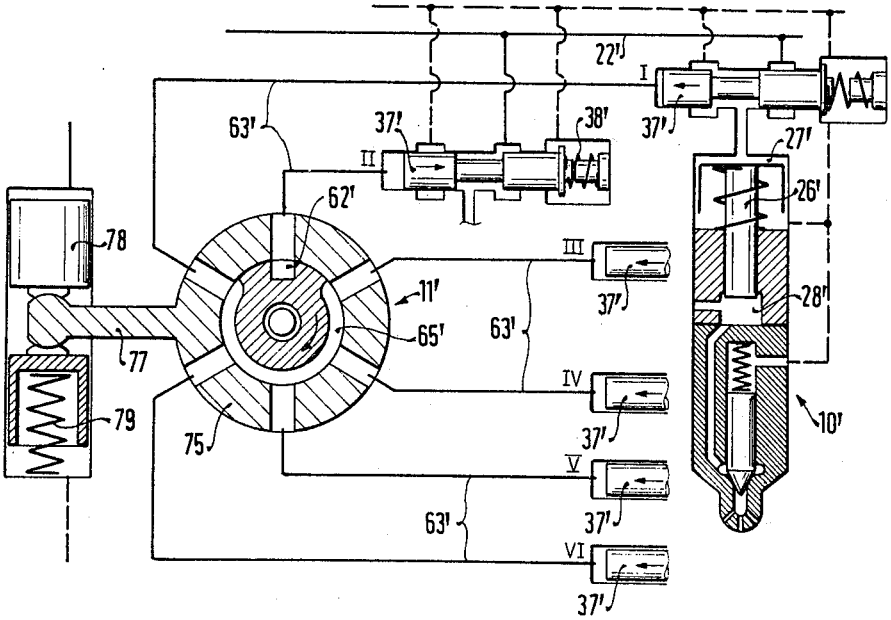

In FIG. 5, a section is shown taken through the distributor along line C of FIG. 2. The pump/nozzles opened by the distributor unit 11' are numbered I–VI. While the control slides 37' of nozzles I, II, IV, V and VI are shown as they execute their return stroke or have already assumed their outset position, the control slide 37' of the pump/nozzle II is moving counter to its restoring spring 38' and thus connects the pressure line 22' with the servopressure chamber 27' of the pump/nozzle. The pump/nozzle 10' or I shown in this drawing is shown in the outset position of the pump piston 26'. In accordance with the control position shown, the control line 63' of the pump/nozzle II communicates with the distributor groove 62'. The control lines 63' of pump/nozzles I and III, IV, V and VI, in contrast, communicate with the longitudinal relief groove 65'.

The distributor 45' is supported in a control sleeve 75, which is rotatably disposed in the housing 76 of the distributor unit 11'. When the control sleeve 75 is rotated, the instant at which the longitudinal distributor groove 62' opens the control line 63' is varied. Because it is intended to vary the injection onset primarily in accordance with rpm, a piston 78 engages one arm 77 of the control sleeve 75, the piston 78 being exposed on its side remote from the arm 77 to fluid whose pressure varies in accordance with the rpm. This variation of the instant of injection should be understood to depend on the rotary position of the engine shaft; that is, it depends on the position of the pistons of the engine. The higher the rpm, the earlier injection should occur, because there is correspondingly less time available for preparation of the fuel than at low rpm. For this reason, as the pressure of the fuel exerted on the piston 78 increases, the piston 78 is displaced downward in FIG. 5; this causes a corresponding variation in the injection onset toward "early", because the distributor groove 62' opens the control line 63' somewhat earlier. The displacement of the piston 78 is effected counter to the force of a restoring spring 79.

The rpm-dependent pressure of this injection onset adjustment apparatus is generated by a pump 80 (FIG. 2), which like the distributor 45' is driven by the engine. The supply pressure of the pump 80 is additionally controlled by a pressure control valve 81, so that it varies in proportion to the rpm. In addition to a line 83 leading to the injection adjustment apparatus, a line 84 branches off from the pressure line 82 of this pump 80 and leads to the metering unit of the pump/nozzles. This line 84 can be blocked by means of a magnetic valve 85. The metering unit housed in the distributor unit 11', in turn, functions with a metering piston 52' whose stroke is variable by means of a stop 53'. The radial bores 54' disposed in the distributor 45' cause the chambers at either side of the metering piston 52' to communicate alternatively with the line 84 or with one of the metering lines 44' leading to the pump/nozzles.

Figure 3:
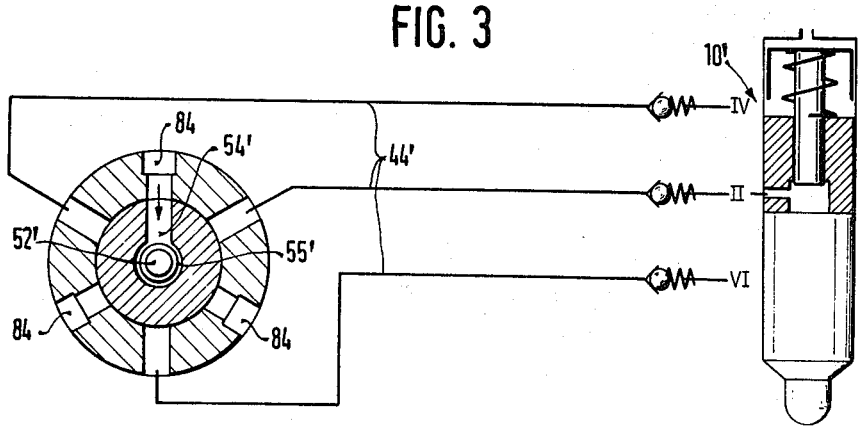

FIG. 3 shows a partial cross section through the distributor unit 11' along the line A of FIG. 2. In the position shown, the fuel can proceed directly from the pump 80 via the line 84 and the radial bore 54' into the chamber 55' ahead of the metering piston 52'. This metering piston 52' is thereby displaced accordingly. The pump/nozzles II, IV, and VI are supplied by the distributor in the plane indicated by the letter A. The metering lines 44', in this position, have just previously been blocked by the distributor 45'.

Figure 4:
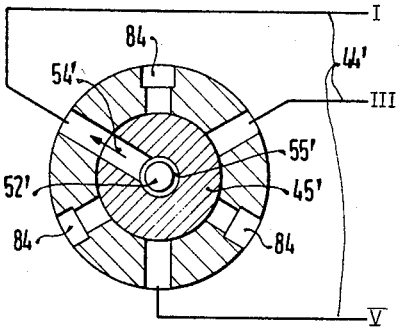

In FIG. 4, a section taken through the middle portion of the distributor unit 11' along the line B of FIG. 2 is shown. The positions in FIGS. 2, 3, 4 and 5 correspond with one another; that is, each of these figures shows one and the same position of the distributor 45'. In section B, the radial bore 54' has just previously opened up one of the control lines 44', specifically that control line 44' leading to the pump/nozzle I. The connections to the inlet line 84 or to the metering lines 44' of the pump-/nozzles III and V are blocked. The metering piston 52' thus forces the fuel, the quantity of which has been determined by the possible stroke length of this piston 52', toward the pump/nozzle I.

Figure 6:
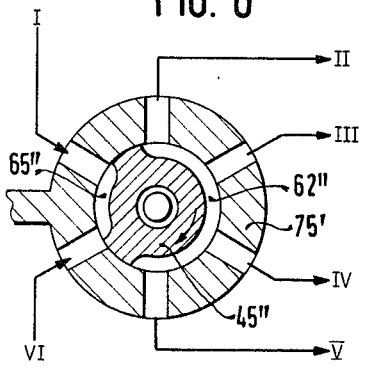
Figure 13:
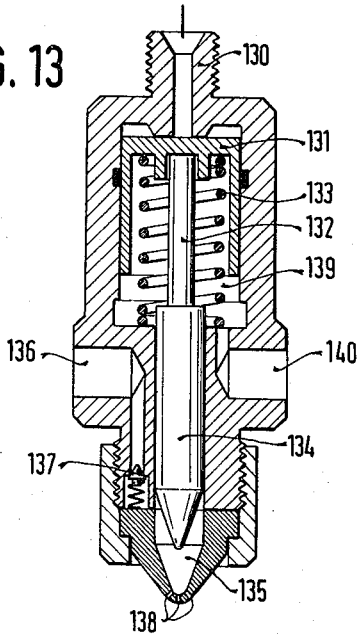

In FIG. 6, in turn, a section is shown which corresponds to that of FIG. 5. The distributor unit 11', however, is embodied to suit a different type of nozzle; that is, it is intended specifically for open nozzles. The open nozzle does not have a nozzle needle; instead, the fuel is stored up just behind the injection ports and injection then occurs as the fuel is pressed by the pump piston through the injection ports. However, to prevent the pump work chamber in an open nozzle of this kind from being filled with gases, the pump piston remains in its extended position until directly before the injection stroke. An open nozzle of this kind is shown in FIG. 13. In FIG. 6, the longitudinal groove 62", which is under fuel pressure, is made sufficiently wide so as to hold the control slides 37' of the pump/nozzle II, III, IV and V in the extended position and thus, correspondingly, to hold the pump pistons in their extended position. The control lines of the pump/nozzles I and VI, in contrast, communicate with the longitudinal groove 65", which is relieved of pressure, so that the associated control slides 37' are in their outset position; as a result, the pump pistons 26' are likewise in their outset position. During this portion of time, the pump work chamber 28' is filled with fuel by the distributor unit in the case of the pump/nozzle I. Then as soon as the distributor 45" has rotated further by about 60°, the pump/nozzle VI is in the injection status, while the pump/nozzle I in contrast is in a status immediately previous to injection. In the pump work chamber 28' of the pump/nozzle II at this time, in contrast, fuel is just now being metered.

In FIGS. 7–11, various apparatuses are shown with which the stop 53 of the metering piston 52 can be adjusted. In other words, these figures show the actual metering apparatus Q.

Figure 7:
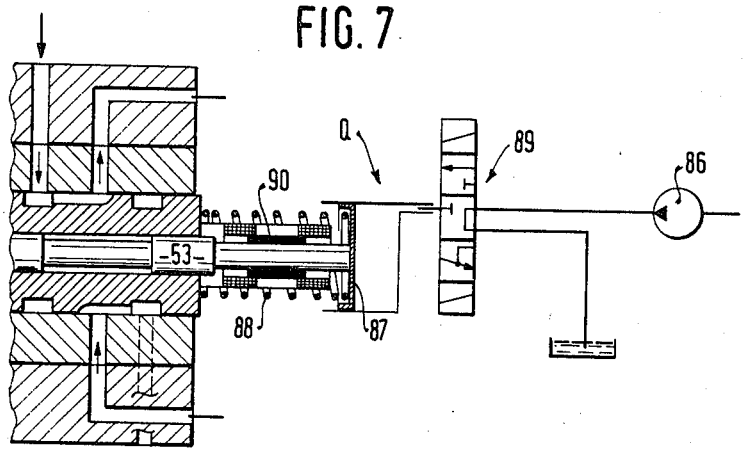

In the example shown in FIG. 7, the adjustment is effected hydraulically. The pressure fluid of a pump 86 serves to adjust a piston 87, which engages the stop 53. The adjustment occurs counter to the force of a restoring spring 88. Instead of the pump 86, a suitable fuel source of the fuel injection system may be used. The control of the fluid is effected via a magnetic valve 89, which is capable of assuming three different switching positions, that is, one neutral position and two different positions each effected by one of the two magnets. In the illustrated initially adjusted position, the adjusting piston 87 is blocked. As soon as the lower magnet is excited, the adjusting piston 87 is displaced by the spring 88 toward the right. As a result, the stroke of the metering piston 52 is lengthened and the injection quantity of the pump/nozzles increases. When the upper magnet of the magnetic valve 89 is excited, the adjusting piston 87 is displaced toward the left, counter to the force of the spring 88, and the injection quantity decreases. The position of the piston 87 at a particular time can be measured by a travel transducer 90, which plays a particularly important role whenever the system is being operated with an electronic control device, as shown in FIG. 1. An apparatus of this kind is particularly significant, given the increasing importance of digital electronic control devices.

Figure 8:
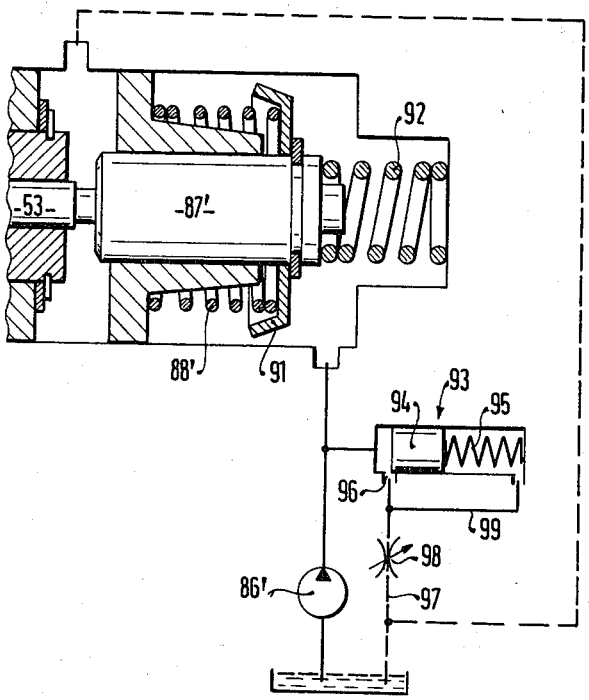

In FIG. 8, a fuel metering apparatus is shown which functions purely hydraulically. The pressure generated by the fluid source 86' is exerted upon an adjusting piston 87', which in turn directly engages the stop 53. The restoring spring 88', which is supported on a spring plate 91, acts counter to a compensating spring 92. The pressure of the adjusting fluid is determined by a pressure control valve 93, at which a piston 94 is displaced counter to the force of a restoring spring 95, thus opening a discharge opening 96 to a greater or lesser extent.

An adjustable throttle 98 is disposed in the discharge line 97 of the pressure control valve 93. Downstream of this throttle 98, a line 99 is provided which leads into the chamber receiving the spring 95. Depending upon how effective the action of the throttle 98 is, the pressure on the rear side of the control piston 94 increases, and thus the pressure exerted on the piston 87' of the quantity adjusting device also increases. The throttle 98 thus acts as a control variable for the fuel injection quantity. If the throttle is reduced in size, the piston 87' is displaced toward the left, and the fuel injection quantity is also reduced. If in contrast the throttle is increased in size, then the piston 87' is displaced toward the right and the injection quantity is increased.

Figure 9:
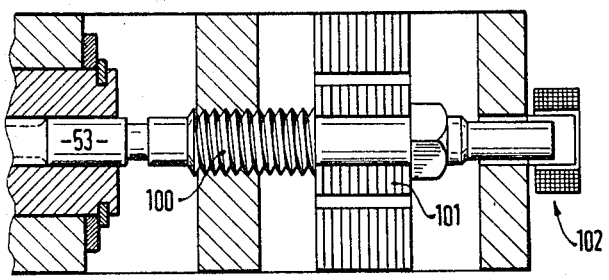

In the exemplary embodiment shown in FIG. 9, the stop 53 is adjusted via a threaded spindle 100, which can be turned by a servomotor 101. The stroke distance travelled by the spindle can be measured via a travel transducer 102. In the case of this apparatus as well, it is advantageous to have it cooperate with an electronic control device.

Figure 10:
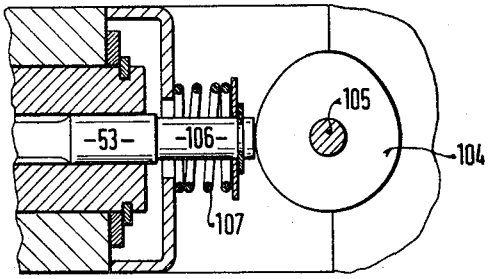

In the exemplary embodiment shown in FIG. 10, the adjustment of the stop is effected via a cam 104, which is actuatable via a shaft 105, which may be a rotary magnet, for example, The cam 104 then displaces an intermediate piston 106 counter to the force of a restoring spring 107.

Figure 11:
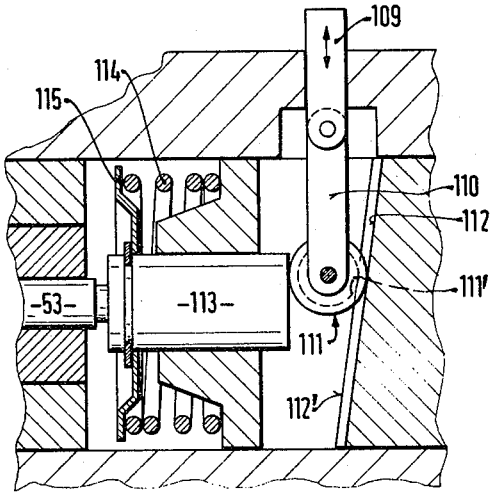

An apparatus with which the restoring forces can be absorbed in particularly favorable is shown in FIG. 11. The stop 53 of the metering piston receives an impact, when the metering piston strikes it, which in relatively feeble adjusting apparatuses may cause incorrect regulation. The direction in which the impact is exerted is in the direction of an increasing injection quantity, so that the consequence of these impacts on the adjusting apparatus may be an undesirable increase in the fuel injection quantity, which accordingly may cause the engine to race.

In the illustrated exemplary embodiment, the control variable is supplied by way of a piston 109 which is displaceable transversely to the distributor axis and which in turn, via a lever 110, displaces a roller having wheels 111 and 111' of a different diameters. This roller is supported on the end with the wheel 111' on an oblique plane 12 and on the other end acts with the wheel 111 upon an intermediate piston 113, which in turn engages the stop 53. The larger wheel 111 is kept free within a groove 112' of the plane 112. In order to assure a constant connection between the stop 53 and the intermediate piston 113, the intermediate piston 113 is urged by a spring 114, which is supported on a spring plate 115, in the direction of the stop 53. The forces exerted by the stop 53 on the piston 109 via the intermediate piston 113 and the roller 111 are thus reduced to a minimum. The transmission of these forces is naturally dependent on the inclination of the oblique plane 112. The flatter the obliquity is, the longer is the distance which the piston 109 must travel to effect a corresponding adjustment of the stop 53.

Figure 12:
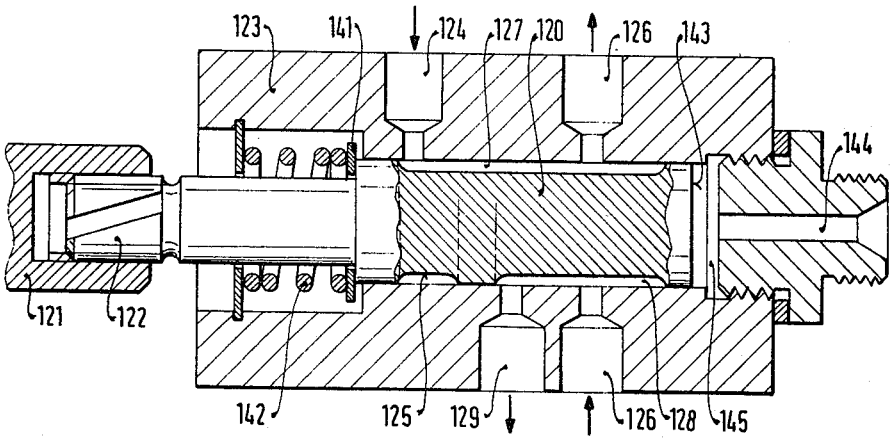
FIGS. 12 and 13 show a distributor unit with axial displacement serving the purpose of injection adjustment.

In FIGS. 12 and 13, the essential elements of an injection system are shown in which the high-pressure fluid which drives the reciprocating piston flows by way of the distributor unit. The distributor 120 is driven by a shaft 121, which rotates at an rpm synchronous with engine rpm and is connected to the distributor 120 by a helical gear via a plug coupling 122. The high-pressure fluid flows by way of a connection bore 124 disposed in the housing 123 of the distributor into an annular groove 125 provided in the jacket face of the distributor. In the housing 123, connection bores 126 are provided which are disposed in a transverse sectional plane and their number corresponds to the number of pump-/nozzles to be supplied. From these connection bores 126, lines lead to the pump/nozzle; that is, one line leads from each connection bore 126 to one of the pump/nozzles. A longitudinal distributor groove 127 is disposed in the jacket face of the distributor 120, and this groove 127 communicates with the annular groove 125 and thus with the connection 124. As soon as the distributor rotates, the connection bores 126 and thus the pump-/nozzles are thus made to communicate in sequence with the pressure connection 124. While one of the connection bores 126 is opened up by the longitudinal groove 127, the other connection bores 126 are opened up by a corresponding number of longitudinal grooves 128, which are likewise disposed in the distributor 120. Thus while high-pressure fuel is supplied via a line to one pump/nozzle, all the other pump/nozzles are being relieved of pressure.

In the pump/nozzle shown in FIG. 13, the line which begins at the connection bore 126 of the distributor unit comes to an end again at a connection nozzle 130. The fuel delivered thence under high pressure exerts its force within the pump/nozzle upon a servo piston 131, which acts upon the valve needle 132, counter to the force of a restoring spring 133. The pump/nozzle is embodied as an open nozzle; that is, the valve needle 132, with a reinforced portion 134, acts directly as the pump piston. The pressure chamber 135 directly below the valve needle is supplied with fuel via a fuel metering apparatus, not shown, by way of the connection 136. Fuel is prevented from flowing back out of the pressure chamber 135 to the connection 136 by a check valve 137. Thus as soon as high-pressure fluid from the distributor unit (FIG. 3) acts upon the servo piston 131, the portion 134 of the pump piston expresses fuel out of the pressure chamber 135 and forces it through injection ports 138 into the cylinders of the engine. There as soon as one of the relief lines is made to communicate, via the longitudinal groove 128 in the distributor, with the connection 130 of the pump/nozzle, the supply piston 131 and thus the valve needle 132 is displaced by the spring 133 into the outset position. The chamber 139 which is arranged to receive the spring 133 and the servo piston 131 is relieved of pressure via a leakage-shutoff bore 140.

The instant at which the injection begins is determined with respect to the rotary position of the drive shaft 121 (FIG. 13) by the opening of one of the connection bores 126 by the longitudinal groove 127. Now in order to be able to vary this instant of injection onset in accordance with rpm, for example, the distributor 120 is rotatable relative to the drive shaft 121. This is effected via the plug coupling 122. To effect an adjustment of this kind, the distributor 120 is axially displaced in the housing 123 via a spring plate 141 counter to a restoring spring 142. The desired relative rotation between the distributor 120 and the drive shaft 121 is then effected by means of the arrangement denoted at 122. This axial adjustment is the result of hydraulic action exerted on the end face 143 of the distributor 120 remote from the shaft 121. Fluid is supplied via an inlet 144 to the chamber 145, which is defined by the end face 143, and the pressure of this fluid is variable, for instance in accordance with rpm. Naturally the pressure may also be variable in accordance with other engine characteristics, depending upon the particular requirements in a given case for a variation of the instant of injection.

The exemplary embodiment shown in FIGS. 12 and 13 is not restricted to a system in which the high-pressure fluid is distributed. A control slide determining the injection onset can also be actuated in the same manner at each pump/nozzle by way of the distributor. It is also possible for a normal, closed nozzle to acts as the nozzle; in this case, then the nozzle needle simultaneously fulfills the function of a valve. The drive shaft 121 may, in particular, be a shaft of the fuel metering system.

In FIGS. 14–19, an injection system having two variations is shown. Here, the fuel metering is effected by means of a reciprocating-piston distributor pump, while in contrast the injection onset is effected by a control means housed in the same distributor. A pump and distributor unit 150 is driven by a motor 151. A fuel supply pump 152 is integrated into the pump and distributor unit 150, its supply of a fuel quantity being dependent on rpm and its supply pressure being controlled in accordance with rpm by a pressure control valve 153. That is, when the rpm increase, the quantity and supply pressure also increase. The distributor unit 150 functions with a piston 154, which simultaneously reciprocates and rotates, being driven by a cam drive 155. The cam drive 155 has a reciprocating cam disc 156 for this purpose, which runs over rollers 158 disposed in a roller ring 157 and as a result of its rising and falling action as it rotates causes the reciprocating movement of the piston 154. The unit is driven via a drive shaft 159, which couples the reciprocating disc 156 and the piston 154 for rotary motion in the manner of a claw coupling 160, without restricting the reciprocal motion of these elements. The pump work chamber is disposed on the side of the pump piston 154 remote from the reciprocating disc 156. It is also defined by a cylinder sleeve 162 and by a shutoff plug 163. This pump work chamber is supplied with fuel from a pump intake chamber 164, which is attached to the pressure side of the supply pump 152. From the intake chamber 164, an intake line 165 leads to the pump work chamber 161, which is controllable by a magnetic valve 166. In addition, access to the pump work chamber 161 is controlled by longitudinal grooves 167 disposed in the piston 154. These longitudinal grooves 167 open the intake line 165 whenever fuel supply to the pump work chamber 161 is desired; that is, this is done substantially during the intake stroke of the pump piston 154. During the pressure stroke of the pump piston 154, which is effected by the reciprocating cam disc 156, one of the metering lines 169 at a time is opened via a distributor bore 168, each of these metering lines 169 leading to one pump/nozzle 170 and corresponding in number to the number of pump/nozzles to be supplied with fuel. The metering lines 169 are distributed on the circumference in a transverse sectional plane of the distributor in accordance with the desired distribution over time of the fuel metering per revolution. The fuel then flows out of the metering line 169 in the appropriate pump/nozzle 170 into the pump work chamber 171, into which a high-pressure pump piston 172 protrudes in order to effect an injection. At least one check valve 173 is disposed in each line 169 in order to prevent the flow of fuel out of the pump work chamber 171 back into the pump work chamber 161.

Figure 15:
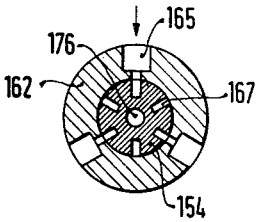

The metering of the fuel is effected by means of an annular slide 174, which is disposed in an axailly displaceable manner about the pump piston 154 and with one end edge controls a relief bore 175, which communicates via a longitudinal bore 175 with the pump work chamber 161. The distributor bore 168 branches off from this longitudinal bore 176. Depending on the axial position of the annular slide 174, this relief bore 175 is opened up earlier or later, and a larger or smaller proportion of the supplied fuel quantity is delivered into the pump work chamber 171 of the pump/nozzle. The axial movement of the annular slide 174 is determined via a lever 177, which is actuated by a converter, not shown in detail, of an electronic control device 178. If it is intended to increase the metered fuel quantity, then the annular slide 174 is displaced toward the right as seen in FIG. 15; if the fuel injection quantity is to be reduced, the annular slide 174 is displaced toward the left.

The adjustment variable determined by the electronic contrl device 178 for the lever 177 or the annular slide 174 is determined by a program fed to it, the input variables of which may be, for example, the position of the gas pedal 179, the rpm n, the temperature or other engine characteristics. The rpm is determined by an rpm transducer 180, which is driven directly by the shaft 159. The magnetic valve 166 may also be controlled by the electronic control device, although it may be controlled simply by an on-off switch instead. The magnetic valve 166, when closed, prevents the metering of fuel.

The piston 172 of the pump/nozzles 170 is driven by a servo piston 182 of larger diameter, counter to the force of a restoring spring 183, whenever this spring 183 is exposed to fluid under high pressure delivered via a line 184 to the individual pump/nozzles. The passage from the high-pressure line 184 through to the pressure chamber 185 in the pump/nozzle receiving the servo piston 172 is controlled by a control slide 186, which can be actuated counter to a restoring spring 187 by means of control fluid derived from the pump and distributor unit 150. In the case of the two pump/nozzles shown in FIG. 15, communication has been established between the high-pressure line 184 and the pressure chamber 185 for the left-hand pump/nozzle I, while in the case of pump/nozzle II this communication has been interrupted by the control slide 186; however, communication has been furnished from the pressure chamber 185 of this pump/nozzle II and a relief line 188. In the non-actuated position of the control slide 186, this element thus establishes the high-pressure communication; in the displaced position, the control slide 186 interrupts this communication and assumes a switching position for pressure relief. In the first instance, an injection occurs, while in the second case metering into the pump work chamber 171 can occur. In each case, as long as the pump piston 172 is displaced downward, fuel is supplied out of the pump work chamber 171 via a pressure line 189 to a pressure chamber 190, and the fuel is then injected into the combustion chamber of the engine via the injection ports 92 after the valve needle 191 has lifted again.

In order to actuate the control slide 186, fluid from the high-pressure line 184 is reduced to a predetermined pressure via a throttle 193 and a pressure control valve 194 and is then delivered to the pump distributor unit 150. The fluid then proceeds via a channel 195 into an annular groove 196 disposed in the jacket face of the distributor. A longitudinal distributor groove 197 branches off from the annular groove 196; during the rotation of the distributor piston 154, this distributor groove 197 opens control lines 198, one after another, which lead to the pump/nozzles, one control line 198 being associated with each pump/nozzle. The control lines 198 are distributed in a single plane about the distributor in accordance with the desired sequence of control.

In order for the control slides 186 of the pump/nozzles to be able to slide back into their outset position, the control lines 198 are opened, during the rotation of the distributor, by a longitudinal groove 199, which communicates with an annular groove 200. The cylinder sleeve 162, within which the pump and distributor piston 154 operates, is disposed in turn in the housing 202 of the pump and distributor unit 150. An annular groove 203 is disposed in the inner bore of this cylinder sleeve 162; after a specified pressure stroke of the pump distributor piston has been executed, this annular groove 203 comes to overlap the annular groove 200. A relief line 204 branches off from this annular groove 203, and a pressure maintenance valve 205 is disposed in the relief line 204. The detailed functioning of the control of the slides 186 is explained below in connection with FIG. 18.

Figure 14:
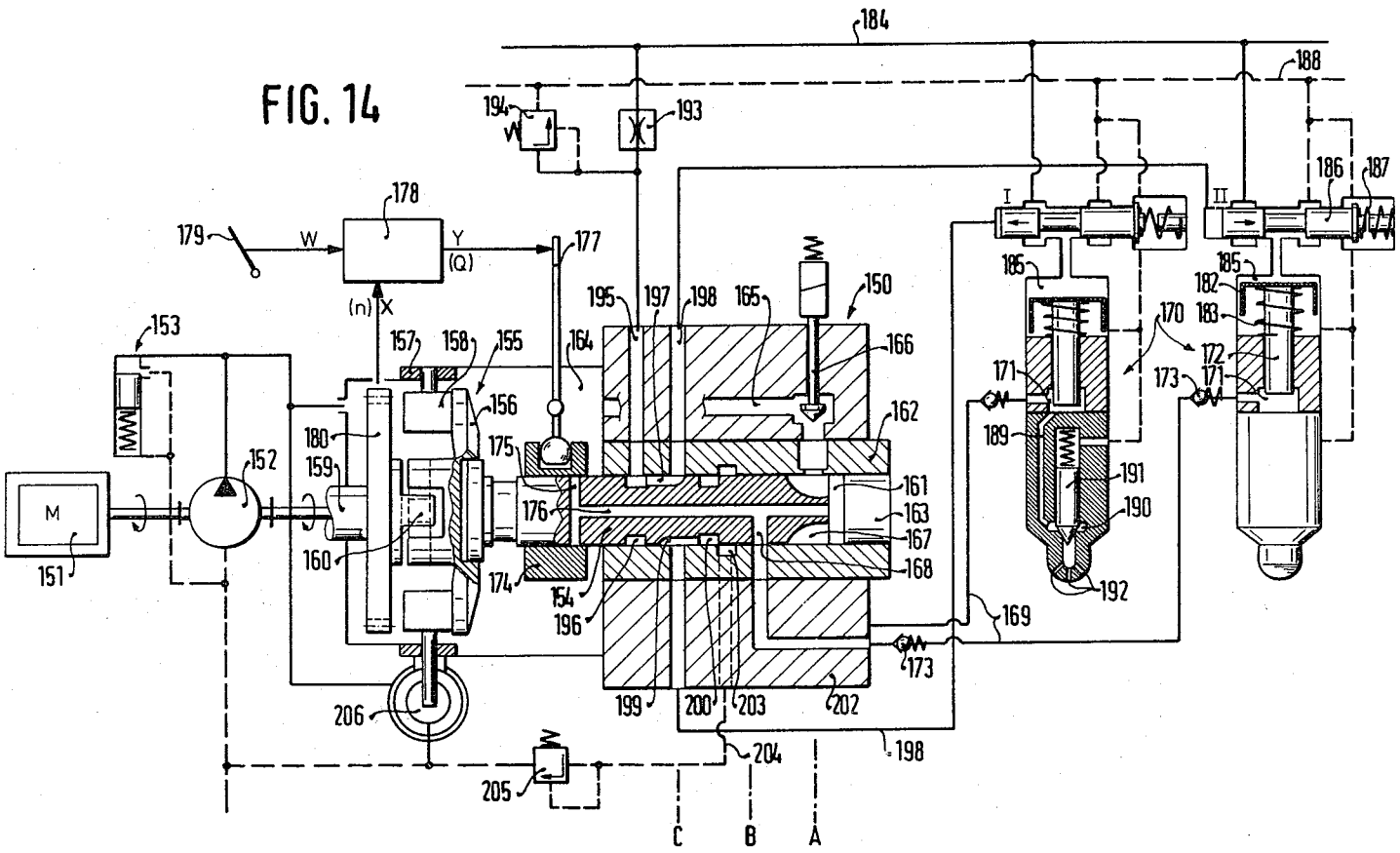
FIGS. 14–19 show a distributor unit with elements of a reciprocating-piston type of distributor pump.

FIG. 15 is a section through the distributor 154 and control sleeve 162 taken along the plane of intersection A of FIG. 14. As shown, three of the longitudinal intake grooves 167 always communicate with a corresponding three intake lines 165 during the period when the pump work chamber 161 is being filled. As a result, it is assured that even in the case of a relatively low pressure in the intake chamber 164 and a relatively short intake period, a sufficient quantity of fuel will reach the pump work chamber 161.

Figure 16:
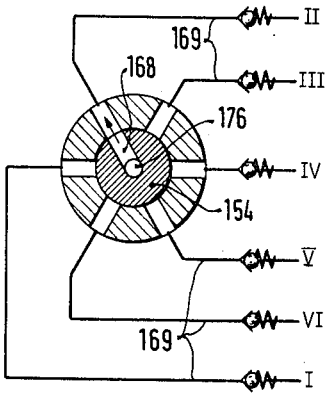

FIG. 16 shows a corresponding section along plane B of FIG. 14. As shown, the distributor bore 168 of the pump and distributor piston 154 is just now opening one of the metering lines 169, specifically that leading to pump/nozzle II. The other metering lines 169 leading to the pump/nozzles I, III, IV, V, and VI are blocked during this time.

Figure 17:
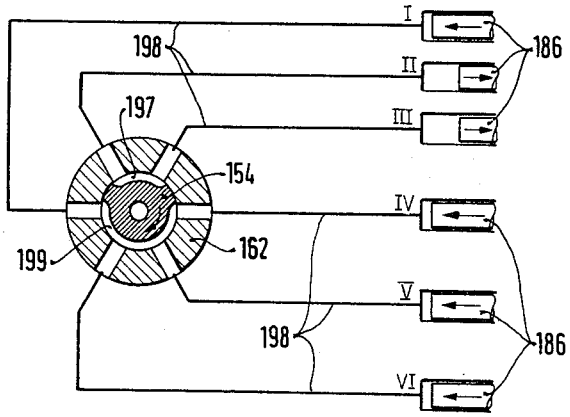

In FIG. 17, a corresponding section along plane C is shown, with which the control of the slides 186 of the pump/nozzles can be explained.

The relief groove 199 on the pump and distributor piston 154 is embodied as relatively wide, so that it simultaneously engages approximately four of the discharge points of the control lines 198. In the illustrated exemplary embodiment, these are the control lines 198 for pump/nozzles I, IV, V and VI. In these pump/nozzles, the control slides 186 are displaced into the outset position, so that the pump piston 172 of the pump/nozzles assumes its retracted position which it assumes at the end of injection. The control lines 198 of the pump/nozzles II and III, in contrast, are under control pressure by way of the longitudinal distributor groove 197; that is, the slides 186 of these two pump/nozzles are displaced counter to their restoring springs 187. Thus in the case of these two pump/nozzles II and III, the servo-pressure chamber 185 communicates with the relief line 188; that is, the pump piston 172 opens the pump work chamber 171 for the purpose of a fuel metering process and is itself displaced by its restoring spring 183 into its outset position. Upon further rotation of the distributor 154, the groove 197 comes to overlap the control line 198 of the pump/nozzle IV. At the same time, the control line 198 of the pump/nozzle II comes to overlap the relief groove 199. In the first case, the control slide of the pump/nozzle IV is accordingly displaced counter to its restoring spring 187, so that the pump piston 172 of the pump/nozzle IV can move into its outset position, and in the second case, the control slide 186 of the pump/nozzle II is displaced by its spring 187 into its outset position, in which it causes the high-pressure line 184 to communicate with the servopressure chamber 185; the result is an injection via the pump/nozzle II. In this described control position of the distributor 154, fuel is metered into the pump/nozzle III via the distributor bore 168 and the metering line 169.

As a result of the manner in which the control slide 186 is controlled, errors which might be caused by pressure changes in the control fluid are substantially prevented. Essentially, the precision of control and the error deviations here are determined by the springs 187. The volume enclosed in the control lines 198 at a particular time is only slightly elastic, so that the rpm-dependent deviation in pressure is the same in all the pump/nozzles of this system. The opening of the relief line 204 via the annular grooves 200, 203 is effected in accordance with the pump and is therefore quite precise. The return stroke of the control slides 186 and thus the injection onset can be initiated only when the two annular grooves come to overlap one another. As shown in FIG. 15, an adjustment of the injection onset can occur as a result of the rotation of the roller ring 157 carrying the rollers 158, of the roller drive mechanism 155. This rotation is effected in a known manner by means of an adjusting piston 206, which is adjustable counter to a restoring force by the rpm-dependent pressure generated by the pump 152. As a result of this adjustment, the pressure stroke of the pump and distributor piston 154 is adjusted relative to the rotary position of the drive shaft 159 and thus to the rotary position of the motor 151. This adjustment of the onset of the pressure stroke, however, also changes the instant at which an opening is created between the annular grooves 200 and 203, and thus changes the beginning of the return stroke of the control slides 186. This latter change, in turn, causes a change in the instant of injection.

Figure 18:
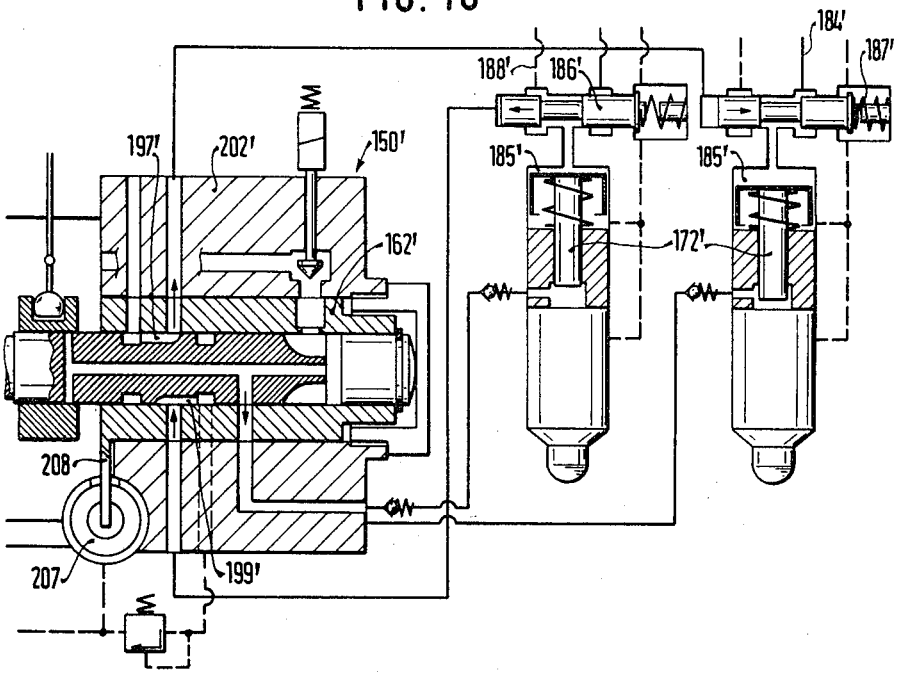
Figure 19:
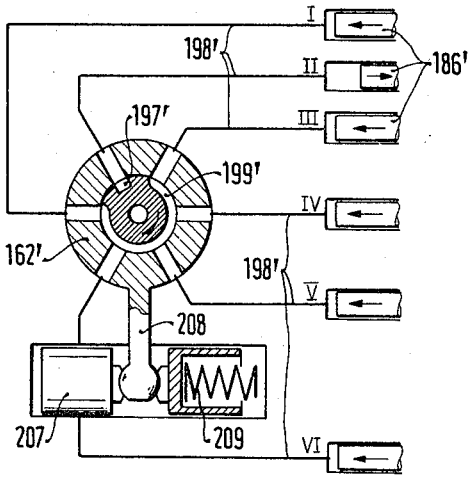

In FIGS. 18 and 19, a variant of the exemplary embodiment is shown. In this example, the control slide, in its state of rest, connects the chamber 185' with the relief line 188' as shown for pump/nozzle I, and in the extended state, wherein it is displaced counter to the spring 187', it connects the servopressure chamber 185' with the high-pressure line 184'. Only when the control slide 186' is being driven by the pump and distributor unit 150' can there be an injection onset. The pump pistons 172' of the pump/nozzles, in their resting positions, thus all move into their outset positions. As shown in FIG. 19, the longitudinal distributor groove 197' is embodied as being narrow, so that in the illustrated example it supplies only the control slide 186' of pump/nozzle II with fuel. The control slides 186' of the pump/nozzles I, III, IV, V, and VI assume their outset position. This outset position is made possible because the longitudinal relief groove 199' is embodied as correspondingly wide, and it encompasses all five discharge points of these five control lines 198'.

A further difference from the preceding exemplary embodiment is that the cylinder sleeve 162' is rotatable within the housing 202' of the pump and distributor unit 150'. The rotation is effected with the aid of a piston 207, which is exposed to the pressure of fluid controlled in particular in accordance with rpm and which via an arm 108 can rotate the cylinder sleeve 162' counter to the force of a restoring spring 209. As may be seen from FIG. 19, a rotation of the cylinder sleeve 162' means that there is a change in the instant at which the distributor groove 197' comes to overlap one of the control lines 198'. This change also means that there is a variation in the time at which the displacement of the control slide 186' begins and thus a change in the instant of injection onset.

However, it is also possible to have a combination of the type of injection onset adjustment from the two described examples. In that case, the rotation of the cylinder sleeve 162' is combined with the cam ring in the control slide arrangement of the first variant. The control grooves are then embodied in accordance with FIG. 19 with the sole difference that the widened control groove, as 199', is subject to control pressure, while in contrast the narrow control groove, as 197', is relieved of pressure. As a result, all the control slides 186' are held in their extended position, except for the one control slide 186' by way of whose associated pump/nozzle an injection is supposed to be taking place at that particular moment. The instant at which this return stroke then begins, and thus the injection onset of the pump/nozzle controlled by the narrow groove, is then varied by means of the rotation of the cylinder sleeve 162.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United Stated is:

1. A fuel injection system for internal combustion engines comprising a plurality of pump nozzles and a high pressure servo fluid source;

each said pump/nozzle including a servo piston, said servo piston including a large diameter portion and a small diameter portion serving as a pump piston, a pump work chamber below said small diameter portion and a servo pressure chamber above said large diameter portion, said servo pressure chamber receiving via a servo pressure line servo fluid from said high pressure servo fluid source for driving said servo piston;

a control apparatus for injection onset arranged to control the flow of servo fluid from said high pressure source to said servo pressure chamber for driving said servo piston in proportion with the cycles of the engine;

and a fuel metering apparatus arranged to determine the fuel quantity of the fuel to be injected and storing up said fuel in said pump work chamber below said pump piston;

said control apparatus and said fuel metering apparatus being driven by a common drive means and combined into a common structural unit comprising a single rotating distributor means;

said fuel metering apparatus comprising a variable stroke metering piston provided with a supply chamber which is alternatively connected via the distributor means with the fuel source and with a pump work chamber.

2. A fuel injection system as defined by claim 1, characterized in that said control apparatus comprises a hydraulically driven switchover valve controlled via said distributor, said valve in one switching position, being arranged to direct the servo fluid from a pressure source to a servopressure chamber above said piston and, in another switching position, arranged to direct the servo fluid from said servopressure chamber to a relief line.

3. A fuel injection system as defined by claim 2, characterized in that said servo fluid actuates said switchover valve to reduce high pressure fluid before said fluid flows through said distributor.

4. A fuel injection system as defined by claim 2, characterized in that said valve which controls the communication between the high-pressure source and the servopressure chamber, in its unactuated position of rest, keeps the high-pressure connection opened.

5. A fuel injection system as defined by claim 1, characterized in that said rotating distributor is synchronized with engine rpm and is positioned in a control sleeve that is movably positioned in a cylinder bore wherein the functions for said control apparatus and said fuel metering apparatus are controlled independently of one another via grooves and bores disposed in said control sleeve and said cylinder, and further that in said control apparatus the fluid source may be connected with at least one pump/nozzle at a particular time, which at least one pump/nozzle is connected at the same time with a relief line.

6. A fuel injection system as defined by claim 5, characterized in that the lines leading to the pump/nozzles are uniformly relieved of pressure via an annular groove disposed in said distributor when said lines are relieved from the fluid source.

7. A fuel injection system as defined by claim 5, characterized in that independent fuel sources are used for said control apparatus and for said fuel metering apparatus.

8. A fuel injection system as defined by claim 1, characterized in that a fuel supply pump is driven with said distributor, said pump being integrated into said structural unit and thereby arranged to furnish the fuel at least for said fuel metering apparatus.

9. A fuel injection system as defined by claim 8, characterized in that said fuel pressure of said fuel supply pump is controlled in accordance with rpm.

10. A fuel injection system as defined by claim 1, characterized in that said metering piston comprises a dual-acting piston and oppositely disposed end faces, each of said end faces being adjacent to a supply chamber and further that said distributor alternatively connects said supply chambers with the fuel source as well as with said pump work chamber of one of said pump/nozzles, so that the fuel source is a supply drive means of said metering piston.

11. A fuel injection system as defined by claim 1, characterized in that said stroke of said metering piston is variable by means of a stop which is adjustable via a metering converter.

12. A fuel injection system as defined by claim 11, characterized in that said metering converter comprises hydraulically actuated control elements.

13. A fuel injection system as defined by claim 12, characterized in that said metering converters are triggered by an electronic control device, which has the actual value fed to it by appropriately disposed transducers.

14. A fuel injection system as defined by claim 1, characterized in that said metering piston is coaxially disposed in a central bore of said distributor.

15. A fuel injection system as defined by claim 14, characterized in that said stop protrudes into said central bore and thereby forms a closure therefore.

16. A fuel injection system as defined by claim, 15, characterized in that said stop is urged in one direction by a force in said supply chamber, said force being partially opposed by a spring exerting its force in the opposite direction.

17. A fuel injection system as defined by claim 15, characterized in that two-structural units are provided, each of said units being provided with stop means and are oriented toward one another on their ends remote from the associated supply chamber, and further wherein a wedge displaceable via a metering converter is disposed between said stops.

18. A fuel injection system as defined by claim 1, characterized in that said stop is adjustable via a threaded spindle.

19. A fuel injection system as defined by claim 1, characterized in that said fuel metering apparatus provides a controllable supply volume for said pump piston.

20. A fuel injection system as defined by claim 19, characterized in that a radial piston pump is arranged to extend transversely to the axis of said distributor.

21. A fuel injection system as defined by claim 19, characterized in that the fuel supply volume of said pump work chamber can be blocked during the intake stroke of said pump piston via at least one magnetic valve.

22. A fuel injection system as defined by claim 1, characterized in that said distributor is further arranged to have a partial reciprocating movement generated by a cam drive, said distributor further including an end portion which together with a cylinder bore defines a pump work chamber.

23. A fuel injection system as defined by claim 22, characterized in that said distributor further includes a relief channel, an annular slide axially displaceable on said distributor to cooperate with said channel, said annular slide controlled by a metering converter and capable during movement thereof to limit supply volume through said distributor.

24. A fuel injection system as defined by claim 1, characterized in that for the purpose of a variation of the instant of injection onset by said control apparatus, the instant of opening up of the line leading from a high-pressure fluid source to the pump/nozzle is variable.

25. A fuel injection system as defined by claim 24, characterized in that said distributor is provided with a coupler means for attachment to a drive shaft to enable adjustment of injection onset.

26. A fuel injection system as defined by claim 25, characterized in that said coupler means comprises a plug element having a helical gear, whereby relative rotation of one of said coupler means provides for a longitudinal displacement of said helical gear.

27. A fuel injection system defined by claim 24, characterized in that said control apparatus for the adjustment of the instant of injection onset comprises an injection onset converter which engages a control sleeve.

28. A fuel injection system as defined by claim 27, characterized in that said injection onset converter comprises an adjusting piston which is exposed to a fluid, said piston being controlled in accordance with rpm, counter to a spring actuated restoring force.

29. A fuel injection system as defined by claim 1, characterized in that said structural unit further includes a rotatable sleeve which cooperates with said distributor and a housing encompassing said sleeve.

30. A fuel injection system as defined by claim 1, characterized in that said distributor means is arranged to execute a stroke movement for fuel metering, and further wherein said stroke is variable via a cam drive and at least a portion of the connecting lines to said pump/nozzle is effectively opened in accordance with this stroke.

* * * * *